US008959815B2

(12) United States Patent
Hopman et al.

(10) Patent No.: US 8,959,815 B2
(45) Date of Patent: Feb. 24, 2015

(54) ADHESIVE CASUALTY AND TRIAGE CARD

(75) Inventors: Lance David Hopman, Tigard, OR (US); Adrian Abram Polliack, Lake Oswego, OR (US)

(73) Assignee: The Seaberg Company, Inc., Wilsonville, OR (US)

( * ) Notice: Subject to any disclaimer, the term of this patent is extended or adjusted under 35 U.S.C. 154(b) by 216 days.

(21) Appl. No.: 13/588,856

(22) Filed: Aug. 17, 2012

(65) Prior Publication Data

US 2013/0043669 A1 Feb. 21, 2013

Related U.S. Application Data

(60) Provisional application No. 61/524,869, filed on Aug. 18, 2011.

(51) Int. Cl.

| | |
|---|---|
| ***G09F 3/10*** | (2006.01) |
| ***B42D 15/00*** | (2006.01) |
| *B42D 25/28* | (2014.01) |

(52) U.S. Cl.

CPC ..... *B42D 15/00* (2013.01); *B42D 25/28* (2013.01)

USPC ..... 40/638; 40/630; 40/586; 40/594; 128/846; 283/74; 283/81; 602/41; 602/58; 602/42

(58) Field of Classification Search

CPC ..... G09F 3/10; G09F 2003/0239; G09F 2003/2041; G09F 2003/0242; G09F 2003/0244

USPC ..... 40/638, 586, 594, 630; 602/2, 20, 41, 602/42, 54, 58; 283/74, 81; 128/846, 877

See application file for complete search history.

(56) References Cited

U.S. PATENT DOCUMENTS

| | | | | |
|---|---|---|---|---|
| 3,874,387 | A | 4/1975 | Barbieri | |
| 4,465,062 | A | 8/1984 | Versaggi et al. | |
| 4,717,382 | A | 1/1988 | Clemens et al. | |
| 4,947,867 | A * | 8/1990 | Keeton | 128/846 |
| 4,949,937 | A | 8/1990 | Waldrum | |
| 5,090,406 | A | 2/1992 | Gilman | |
| 5,160,322 | A | 11/1992 | Scheremet et al. | |
| 5,195,977 | A | 3/1993 | Pollitt | |
| 5,263,922 | A | 11/1993 | Sova et al. | |
| 5,431,633 | A | 7/1995 | Fury | |
| 5,478,333 | A | 12/1995 | Asherman, Jr. | |
| 5,558,918 | A | 9/1996 | Gordon | |
| 5,967,559 | A | 10/1999 | Abramowitz | |
| 6,108,957 | A | 8/2000 | Zapawa | |
| 6,149,614 | A | 11/2000 | Dunshee et al. | |
| 6,228,390 | B1 * | 5/2001 | Kundel | 424/448 |
| 6,305,605 | B1 | 10/2001 | Goetz et al. | |

(Continued)

OTHER PUBLICATIONS

The Seaberg Company, Inc., Int'l Search Report & Written Opinion, PCT/US12/51449, Nov. 2, 2012, 8 pages.

(Continued)

*Primary Examiner* — Casandra Davis

(74) *Attorney, Agent, or Firm* — Chernoff, Vilhauer, McClung & Stenzel, LLP

(57) ABSTRACT

A casualty and triage information collection form and record sheet of flexible plastic film including a writing surface and backed by a layer of an adhesive by which the record sheet can be attached to a patient's clothing or skin. The flexible plastic film is strong enough and elastic enough to serve as a wound dressing. The adhesive is protected before use by a release liner sheet.

33 Claims, 7 Drawing Sheets

(56) References Cited

U.S. PATENT DOCUMENTS

| | | | | |
|---|---|---|---|---|
| 6,537,658 | B1 | 3/2003 | Bruss et al. | |
| 6,569,189 | B1 | 5/2003 | Augustine | |
| 6,723,079 | B2 | 4/2004 | Cline | |
| 6,773,807 | B2 | 8/2004 | Landberg et al. | |
| 7,005,170 | B1 | 2/2006 | Simpson et al. | |
| 7,205,449 | B2 | 4/2007 | Levin | |
| 7,429,687 | B2 | 9/2008 | Kauth et al. | |
| 7,454,854 | B2 | 11/2008 | Riley et al. | |
| 7,531,711 | B2 | 5/2009 | Sigurjonsson et al. | |
| 7,615,674 | B2 | 11/2009 | Asherman | |
| 7,624,869 | B2 | 12/2009 | Primer | |
| 7,777,092 | B2 | 8/2010 | Lykke et al. | |
| 7,941,949 | B2 | 5/2011 | Cloninger | |
| 7,964,228 | B2 * | 6/2011 | Milliorn | 426/383 |
| 7,971,710 | B1 | 7/2011 | Zaher | |
| 2001/0047144 | A1 | 11/2001 | Tillotson et al. | |
| 2002/0040202 | A1 * | 4/2002 | Levin | 602/43 |
| 2004/0049146 | A1 | 3/2004 | Kolte | |
| 2004/0056477 | A1 * | 3/2004 | Bruce | 283/81 |
| 2006/0242875 | A1 | 11/2006 | Wilson et al. | |
| 2006/0266368 | A1 * | 11/2006 | Heintz | 128/846 |
| 2007/0251849 | A1 | 11/2007 | Lo | |
| 2008/0091152 | A1 | 4/2008 | Asherman | |
| 2008/0108925 | A1 | 5/2008 | Kaplan | |
| 2009/0091120 | A1 * | 4/2009 | Welsh | 283/74 |
| 2009/0209894 | A1 | 8/2009 | McAllister | |
| 2010/0242324 | A1 | 9/2010 | Waltersdorf | |
| 2012/0046582 | A1 | 2/2012 | Hopman et al. | |

OTHER PUBLICATIONS

The Seaberg Company, Inc., Int'l Search Report & Written Opinion, PCT/US11/47777, Mar. 27, 2012, 15 pages.

SAM Chest Seal, Occlusive Dressing for Open Chest Wounds, 2 pages, retrieved from the Internet on Feb. 2, 2012 <http://www.sammedical.com/samchestseal.html>.

HyFin Chest Seal, 2 pages, retrieved from the Internet on Feb. 2, 2012 <http://www.narescue.com/Hyfin_Chest_Seal-CN1BB57448570E.html>.

PMI Halo Seals, High performance occlusive dressing . . . , 1 page, retrieved from the Internet on Feb. 2, 2012 <http://chestseals.com/>.

DA Form 7656, Sep. 2009, 2 pages, retrieved from the Internet on Jul. 1, 2013, URL <http://www.usaisr.amedd.army.mil/assets/pdfs/TCCC_Card_DAForm7656_Sep2009.pdf>.

* cited by examiner

ADHESIVE CASUALTY AND TRIAGE CARD

CROSS-REFERENCE TO RELATED APPLICATIONS

This application claims the benefit of the filing date of U.S. Provisional Patent Application Ser. No. 61/524,869 filed Aug. 18, 2011.

BACKGROUND OF THE INVENTION

The present invention relates to trauma treatment and collection and preservation of information concerning trauma treatment, and particularly to recordkeeping regarding initial field treatment of injuries such as military field casualties or civilian mass casualties.

Transfer of casualties from a prehospital setting, particularly on a battlefield or resulting from a civilian tragedy such as a large highway collision or train wreck, to a more capable and comprehensive care center is often chaotic. It is important that information about field treatments performed by first responders be recorded, so that the emergency physicians receiving these patients at another site can effectively conduct triage and treat the patients. Currently the U.S. military services use a combat casualty card such as the one illustrated in FIGS. 1 and 2 of the drawings to record this information.

Such a combat casualty card is typically made of paper, laminated with plastic, and is attached to the patient via a lanyard composed of string, wire, rubber band, or the like. The first responder will fill out the information at the location where first aid is provided, and the patient will be transported to the site where the next level of care is available.

Unfortunately, especially in a battlefield, only a low percentage of casualties that arrive where the next level of care is available have these casualty/information cards still attached. This is for a variety of reasons. If the card is tied to clothes, the clothes may have be removed and discarded before the emergency physician or surgeon can see the patient. Or, the card might fall off or be ripped off the clothes at some point. Likewise, attachment of the card's string or other lanyard to the patient is not robust, and the cards may simply be lost in transit. Additionally, a card may not have been filled out in the first place, because of the chaos where a casualty occurred, or simply because of inconvenience, or a shortage of available casualty information cards. Attachment of a card to the patient may also be difficult due to the loss of limbs or appendages via traumatic amputation.

What is desired, then, is an improved casualty recording device that is not likely to become separated from an injured person before arrival at a site where additional medical care is available, so that valuable information recorded on the device can be used there to improve the efficiency of care given to a patient.

SUMMARY OF THE INVENTION

As defined by the claims forming a part of this disclosure, the present invention provides a casualty information record sheet that is adhesive backed so as to increase the incidence of successful transfer of patient condition and emergency treatment information to a facility where the next level of care may be available. An adhesive-backed casualty card that is one embodiment of the invention could be placed on the patient's skin or clothing. If the skin or clothing is not conducive to adhesive attachment, the card could still be attached to the patient by the traditional lanyard type system.

In one embodiment of the invention disclosed herein the card, due to its adhesive and occlusive nature may also be used as a wound seal for chest trauma, lacerations, eviscerations, and other wounds commonly encountered in the prehospital setting, in accordance with a method disclosed herein. This provides the possibility of a multifunctional device that is easy to use and that stays with a patient during transport from a first aid site to an emergency medical care facility of greater capability.

The foregoing and other objectives, features, and advantages of the invention will be more readily understood upon consideration of the following detailed description of the invention, taken in conjunction with the accompanying drawings.

BRIEF DESCRIPTION OF THE SEVERAL DRAWINGS

DETAILED DESCRIPTION

Figure 1:
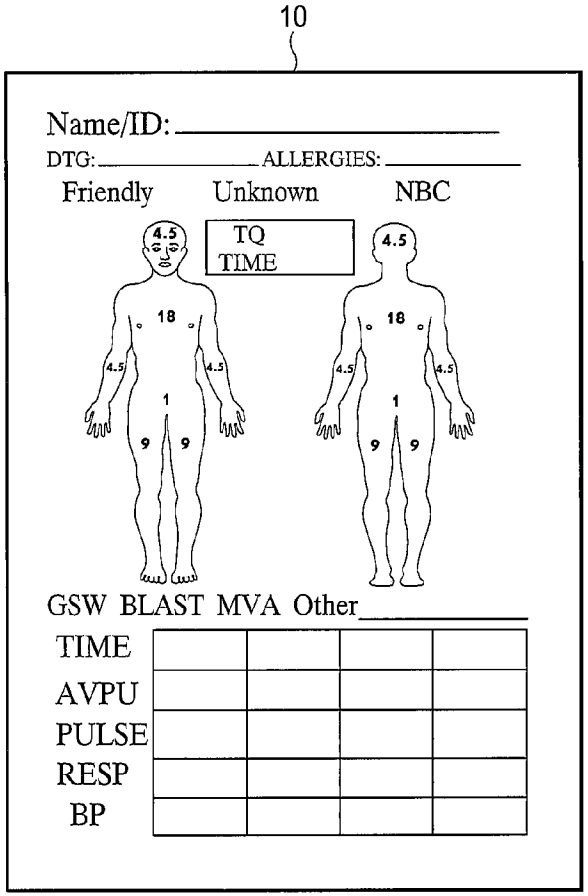
FIG. 1 PRIOR ART
FIG. 1 is a depiction of a front side of a prior art combat casualty card used by U.S. military services.
Figure 2:
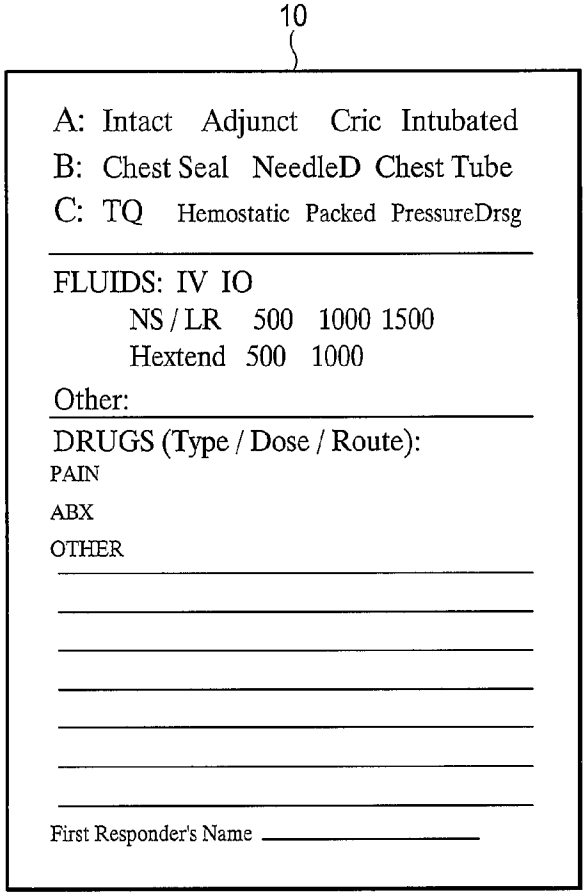
FIG. 2 PRIOR ART
FIG. 2 is a depiction of the reverse side of the combat casualty card shown in FIG. 1.

Referring now to the drawings, FIGS. 1 and 2 show the front and reverse of a typical combat casualty card 10 such as those used by the United States military services as mentioned above.

Figure 3:
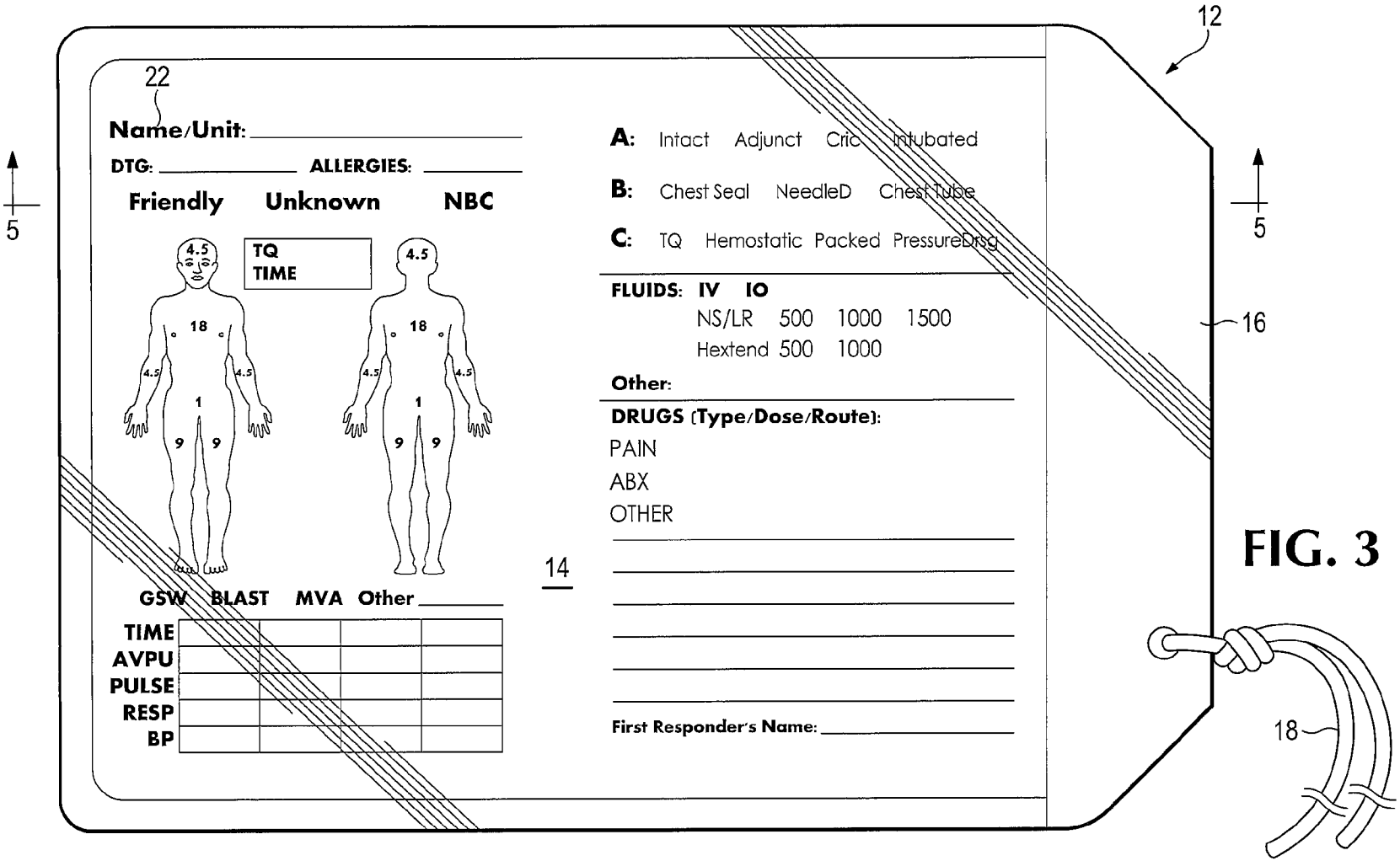
FIG. 3 is a view of the front side of a patient casualty and triage information device according to the present disclosure.
Figure 4:
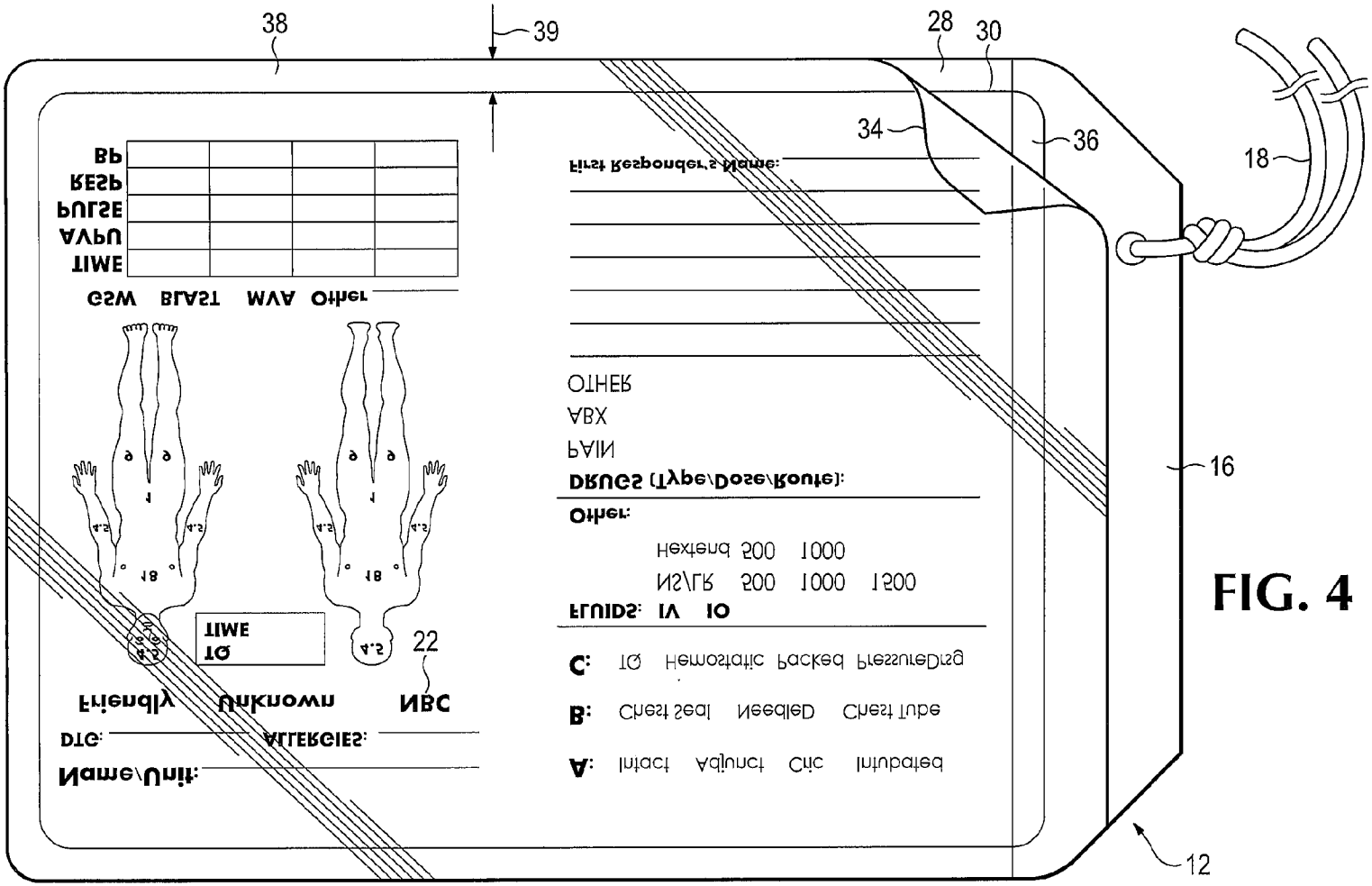
FIG. 4 is a view of the reverse side of the patient information device shown in FIG. 3.

FIGS. 3 and 4 show, respectively, the front and reverse of a casualty information and triage record card device 12 which is a first embodiment of the invention disclosed herein, and which will be referred to herein at times as an information card 12, for the sake of brevity.

The information card 12 has imprinted on it nearly the same form as in the combat casualty card 10 illustrated in FIGS. 1 and 2, providing symbols and spaces for recording wound and treatment information with the equivalents of the front and reverse of the combat casualty card 10 arrayed side by side and legible on the front face 14 of the information card 12. The front face 14 is a writing surface that may be written upon by a first responder using a pen or similar writing implement. The information card 12 is adhesive-backed and has a release liner, as will be explained in greater detail below, and also has a handle or tag 16, to which a loop of string 18, or other attachment device might be attached.

Figure 5:
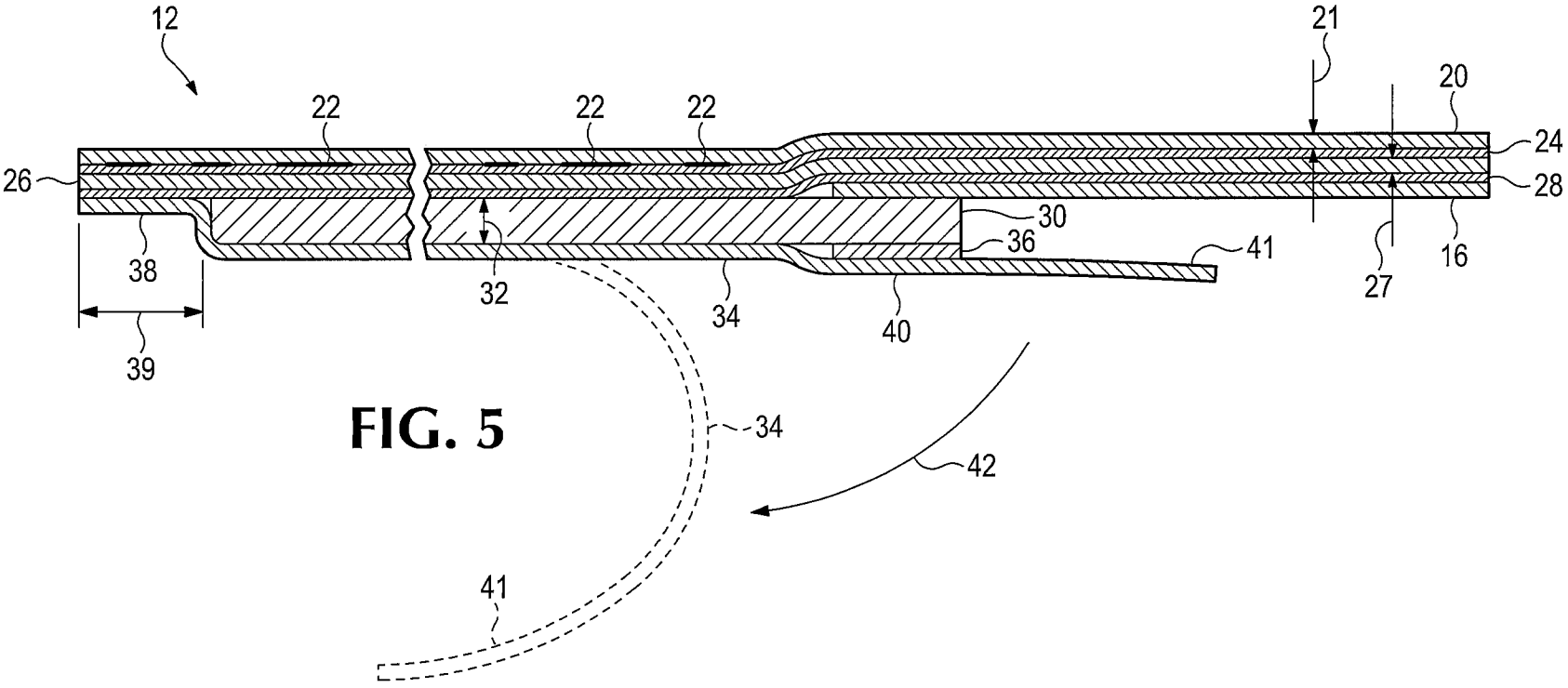
FIG. 5 is a foreshortened, sectional view, exaggerated in scale in a thickness direction, of the device shown in FIGS. 3 and 4 taken along line 5-5 in FIG. 3.
Figure 6:
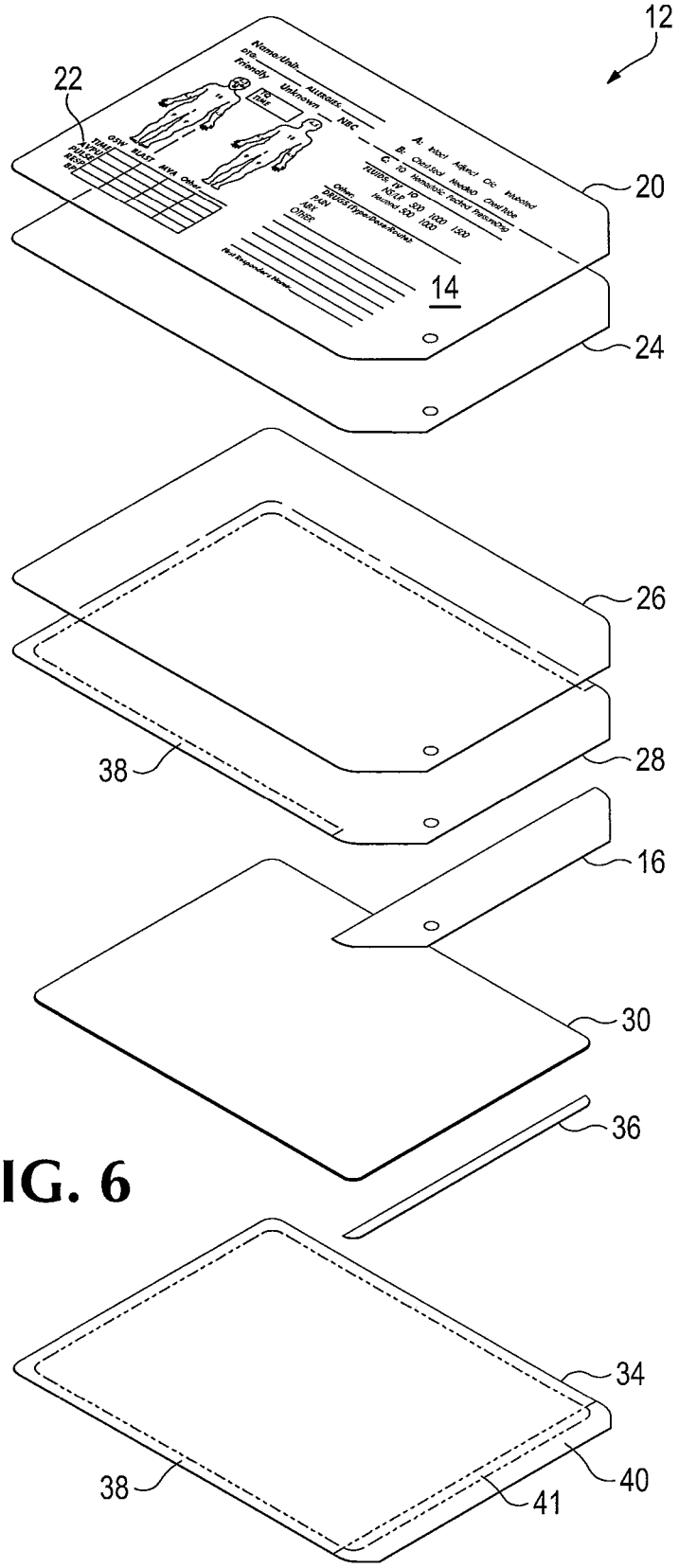
FIG. 6 is an exploded isometric view of the device shown in FIGS. 3-5.

Referring also to FIGS. 5 and 6, the device 12 is constructed of flexible polymeric plastics films interconnected with each other by layers of adhesive material. In particular, in the embodiment shown in FIGS. 5 and 6, the front face 14 is the outer surface of a top layer 20, which may be of transparent polyurethane film or another flexible polymeric plastic on which printing can be accomplished practically, and on whose underside may be an imprinted layer 22 of ink forming the information requesting form visible on the front face 14. The top layer 20 may have a thickness 21 in the range of 0.001-0.005 inch and in one embodiment its thickness 21 is 0.002 inch. A layer 24 of an adhesive covers the lower surface of the top layer 20 and adhesively attaches a second layer 26 of a flexible polymeric plastics film, which may be, for example, polyethylene or another flexible polymeric plastic, and which protects the imprint 22 of ink on the bottom of the top layer 20 from most hazards or materials, such as alcohol or other solvents which might be used in connection with initial cleaning of a wound. The second layer 26 may also have a thickness 27 in the range of 0.001-0.005 inch, and about 0.002 inch in one embodiment. In one embodiment of the device 12 the upper layer 20 might be transparent in order to facilitate clearly seeing the information request form, while the lower layer 26 might be opaque or semi-opaque, with a definite color that contrasts with the color of the ink of the information request form and the color of the ink of a pen likely to be available to a caregiver using the device 12. Another thin layer 28 of an adhesive material such as an acrylic adhesive or a rubber-based adhesive may be present on the underside of the second layer 26. The adhesive layer 28 is used to attach the handle or tag portion 16 to the plastic film structure bearing the imprint layer 22 of the information-requesting form.

The exposed outer surface of the top layer 20 is thus made available as a writing surface on which a first responder caregiver can record the available critical information regarding a patient's condition and any treatments that have been given or withheld. The writing surface of such polymer plastics material can usually accept ordinary ball point pen ink, "Sharpie" ink, or alcohol based inks such a felt tip pen inks, among others.

A layer 30 of an adhesive material intended to attach the device, and thus recorded medical care information, securely to a person's clothing or skin, overlies the layer 28 of adhesive.

The adhesive 30 is preferably moisture absorbent, to facilitate adhesion to wet, sweaty, or bloody skin or clothing. For example, the adhesive material 30 may be a hydrogel adhesive or a hydrocolloid adhesive. Such moisture absorbent adhesive may be provided in a layer 30 significantly greater in thickness than the layer 28, with a thickness 32 which may be, for example, 0.032 inch, for certain adhesives. Alternatively, the adhesive material 30 may be acrylic, rubber-based, silicone-based or another adhesive for which the thickness 32 could be less. Although they are not as desirable, due to low moisture uptake, such other adhesives could be used in situations where dry skin and clothes are expected. In the embodiment shown in FIGS. 3-6, the device 12 has the hydrogel adhesive 30 in a central portion of the bottom face of the layer 26 to aid in adhesion to a wet or moist surface, while the acrylic/rubber based adhesive layer 28 may be left exposed around the adhesive layer 30, where it can aid in adhesion to a dry surface.

The layer of adhesive material 30 may extend and overlap slightly along an inner margin of the handle 16, and a liner tab, or separator cover strip 36 may be provided to cover and adhere to that portion of the layer 30 of adhesive material.

A release liner sheet 34 overlies and is held removably by the layer 30 of adhesive material and extends beyond it to the edges of the layers 20 and 26 of flexible film, so that a narrow peripheral strip 38 of the release liner sheet 34 is adhered to the second layer 26 of flexible film by the portion of the adhesive layer 28 located along the top and bottom and the left end of the information card 12, as shown in FIGS. 3 and 4. The narrow peripheral strip 38 may have a width 39 of, for example, 0.25 inch, depending on the viscosity of the adhesive material of the layer 30, in order to resist any tendency of the adhesive material 30 to ooze out between the lower layer 26 of polymeric film and the release liner sheet 34, which might make it likely that the device will stick to the inside of a package in which it is contained prior to use. Where the adhesive of the layer 30 is not likely to ooze the peripheral strip 38 could be omitted.

The release liner sheet 34 may be of a synthetic polymeric plastic such as polyethylene terephthalate (PET), with a thickness of 0.002-0.005 inch, which is somewhat stiffer than the polyurethane or polyethylene or other flexible and elastic plastics preferred for the top layer 20 and second layer 26. The release liner sheet 34 can thereby stiffen and provide some support for the remainder of the device 12 and resist undesirable wrinkling and self adhesion in the layer 30 of adhesive material prior to use of the device 12, that might impede its use as a wound dressing or make it more difficult to write on the front face 14. The release liner sheet 34 can be opaque or have an opaque coating to provide visual contrast to the ink layer 22 while a first responder writes on the writing surface 14.

A portion 40 of the release liner sheet 34 lies over the liner tab 36 and parallel with the handle or tag portion 16 but is free from adhesive attachment thereto so that the outer margin 41 of the release liner sheet 34 can easily be grasped and pulled back to peel the release liner sheet 34 away from the layer 30 of adhesive and any surrounding peripheral strip 38 of the adhesive layer 28, as suggested by the arrow 42 in FIG. 5.

Where the adhesive material 30 is a rubber-based adhesive, or acrylic-based, or is of some types of hydrocolloids, the release liner sheet 34 could be of a silicone coated paper release material.

Once the release liner sheet 34 has been removed the device can be carried by the handle 16 as it is placed where desired on a patient, without adhering to the first responder's hands as the device 12 is placed on a person.

The performance of the adhesive material 30 in attaching the device to a person's skin may be enhanced by the elasticity of the dressing format. If the backing, that is, the top and second layers 20 and 26, is an elastic material such as polyurethane, a person's movements will be less likely to cause the device 12 to come apart from the person's skin or from a dressing on the person's skin being protectively covered by the device 12. Other backing materials on which the information requesting form may be imprinted preferably also have elasticity, but the film layers 20 and 26 could be of a flexible film that is inelastic, as well.

The lanyard 18 may be attached to the device 12 via a punch hole in the card itself or on the handle 16 extending from the card, as shown in FIGS. 3 and 4, or a suitable fastening device may be adhered in some other fashion. The lanyard 18 may be of any material, such as string, rubber, wire or the like.

The device 12 may be transparent to allow for observation of the skin to which the device 12 is adhered or a wound covered by the applied device 12, through the layers carrying the information requesting form. The device 12 may instead be opaque or have a degree of opacity to provide some contrast and thus facilitate reading information recorded on the device 12 when it is in place on various colors of backgrounds, including persons of various skin colors. The handle or tag 16 may be of a strong flexible plastic film and may be opaque or translucent and of bright, easily recognizable colors, in order to convey a patient's status, or simply to facilitate visualization and identification of the card 12 by caregivers attending to the person where the next level of care is available. Alternatively, it may have dark colors, such as black, to aid in low light or night visualization.

Figure 7:
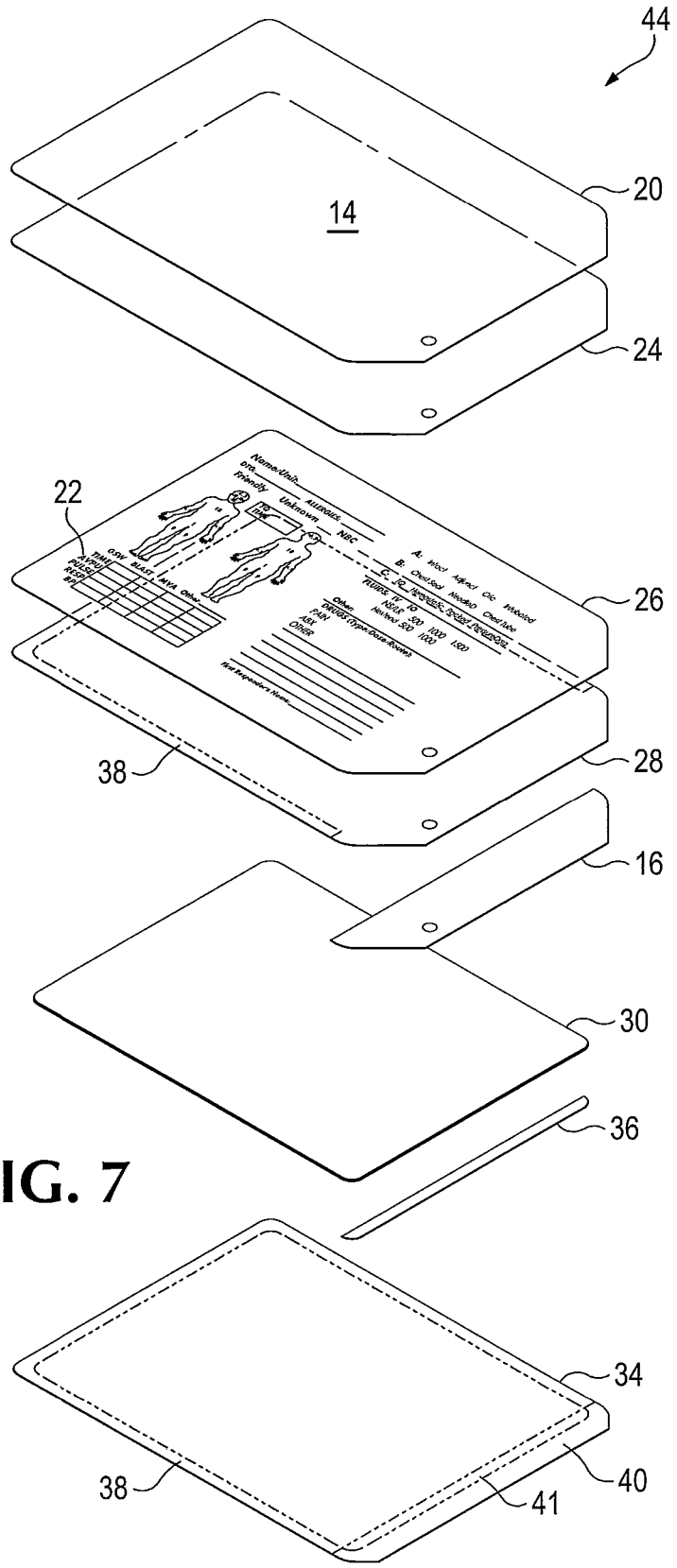
FIG. 7 is a view similar to FIG. 6, showing an alternative embodiment of the device.

In a second embodiment 44 of the disclosed device, as shown in FIG. 7, the imprint 22 of the information requesting form may be applied on the upper face of the second layer 26 of polyethylene or other thin flexible plastics material, so that the top layer 20 of polyurethane, attached by the layer 24 of adhesive material, protects the ink 22 of the imprinted form.

Figure 8:
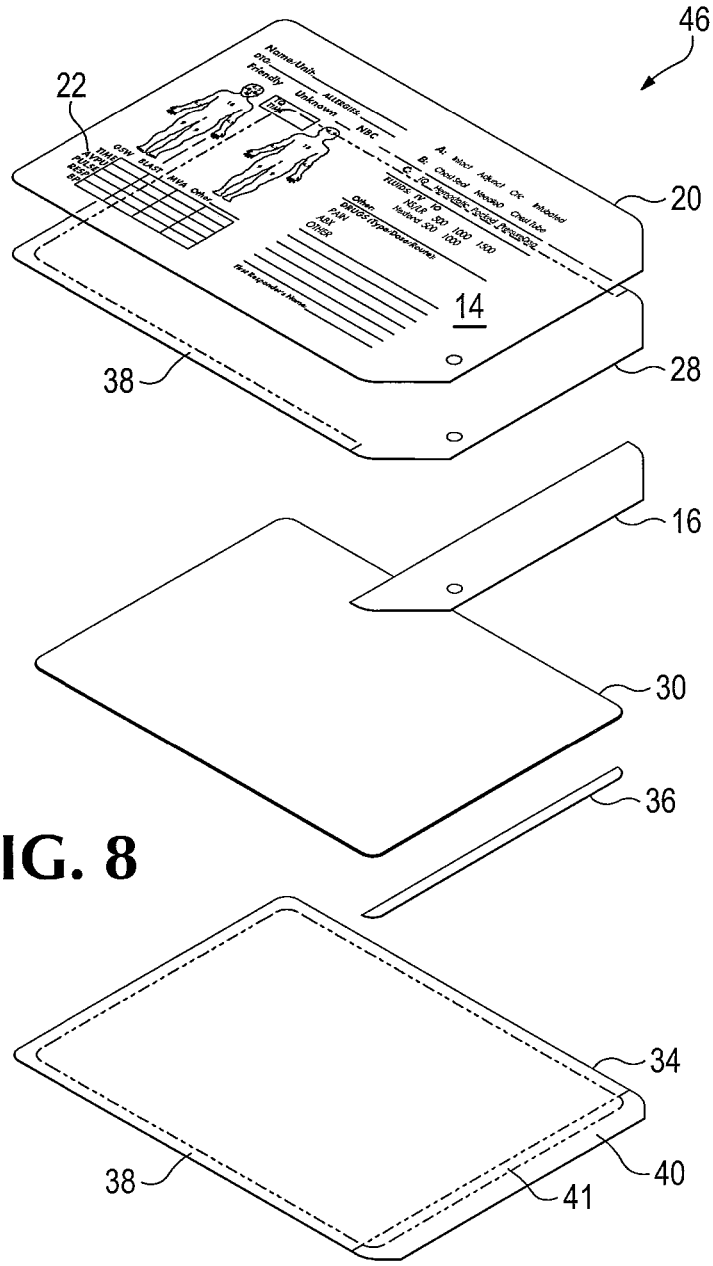
FIG. 8 is a view similar to FIG. 6, showing another alternative embodiment of the device.

A third alternative embodiment 46 of the device, as shown in FIG. 8, includes a top layer 20 on whose lower or bottom face the ink imprint 22 of the information requesting form may be applied, so that the flexible film of the layer 20 itself protects the imprinted form from abrasion or solvents on the outside of the device 44. Alternatively, the imprint 22 of the form could be on the top surface of the top layer 20, if ink is used that is suitably resistant to abrasion or solvents when used on the material of the layer 20. A layer 28 of adhesive material, such as used in the device 12 covers and protects the layer 22 of ink of the imprinted form if it is on the underside of the top layer 20, and the handle 16, layer 30 of adhesive material, liner tab 36, and release liner sheet 34 are applied and retained by the adhesive layer 28 as described above with respect to the device 12 shown in FIGS. 3-6.

The adhesive-backed information card 12, 44, or 46 is occlusive, so it may be used also as a dressing to cover a wound contact material or it may be used as a wound contact and sealing dressing itself. Wounds for which use of the device 12, 44 or 46 would be appropriate include but are not limited to open chest wounds, lacerations, bleeding wounds, eviscerations, and others.

The terms and expressions which have been employed in the foregoing specification are used therein as terms of description and not of limitation, and there is no intention in the use of such terms and expressions of excluding equivalents of the features shown and described or portions thereof.

We claim:

1. A device for recording medical information for an injured person, comprising:

(a) a sheet of a flexible film including an imprinted form suggesting desired patient information and including a writing surface on which to record patient information;

(b) a fastening layer of an adhesive material associated with and arranged with respect to said sheet of flexible film so as to be capable of adhering said sheet of flexible film to an injured person;

(c) a release liner sheet adhered to said layer of adhesive material and including a handle extending free of said layer of adhesive material to facilitate removal of said release liner sheet to expose said layer of adhesive material for use in attaching said sheet of a flexible film to an injured person;

(d) a handle portion of plastic film material extending along a margin of said sheet of a flexible film, said handle portion being free from said layer of adhesive material and from said release liner sheet; and (e) a lanyard attachment.

2. The device of claim 1 wherein said sheet of a flexible film is sufficiently strong, elastic, and flexible to be used as a wound dressing to be attached by said fastening layer of an adhesive material.

3. The device of claim 1 wherein said sheet of a flexible film includes two layers of flexible film laminated together by an adhesive, and wherein said form is imprinted on a surface of one of the two layers confronting the other one of the two layers, so that the form is contained between the two layers.

4. The device of claim 1 wherein said fastening layer of an adhesive material includes an adhesive material of a first kind in a central area and an adhesive material of a second kind in a narrow peripheral border strip at least partially surrounding said central area, said adhesive material of said second kind being capable of limiting spread of said adhesive of said first kind when said release liner sheet is adhered to said layer of adhesive material of said second kind.

5. The device of claim 4 wherein said first kind of adhesive material is a hydrogel.

6. The device of claim 5 wherein said second kind of adhesive material is an acrylic-based adhesive material.

7. The device of claim 6 wherein said peripheral border strip has a width of at least about 0.25 inch.

8. The device of claim 4 wherein said first kind of adhesive material is a hydrocolloid.

9. The device of claim 8 wherein said second kind of adhesive material is an acrylic-based adhesive material.

10. The device of claim 9 wherein said border strip has a width of at least about 0.25 inch.

11. The device of claim 1 wherein said release liner sheet is stiffer than said sheet of a flexible film.

12. The device of claim 1 wherein said adhesive material of said fastener layer is an acrylic-based adhesive material.

13. The device of claim 1 wherein said adhesive material of said fastener layer is a rubber-based adhesive material.

14. The device of claim 1 wherein said flexible film is of polyurethane.

15. The device of claim 1 wherein said flexible film is of polyethylene.

16. The device of claim 1 wherein said flexible film has a thickness in the range of 0.001 inch-0.005 inch.

17. A device for recording medical information for an injured person, comprising:

(a) a sheet of a flexible film including an imprinted form suggesting desired patient information and including a writing surface on which to record patient information;

(b) a fastening layer of an adhesive material associated with and arranged with respect to said sheet of flexible film so as to be capable of adhering said sheet of flexible film to an injured person;

(c) a release liner sheet adhered to said layer of adhesive material and including a handle extending free of said layer of adhesive material to facilitate removal of said release liner sheet to expose said layer of adhesive material for use in attaching said sheet of a flexible film to an injured person;

(d) a handle portion of plastic film material extending along a margin of said sheet of a flexible film, said handle portion being free from said layer of adhesive material and from said release liner sheet; and (e) a separator cover strip of plastic film attached to said handle portion by a marginal portion of said fastener layer of an adhesive material and confronting said release liner sheet.

18. The device of claim 17 wherein said sheet of a flexible film is sufficiently strong, elastic, and flexible to be used as a wound dressing to be attached by said fastening layer of an adhesive material.

19. The device of claim 17 wherein said sheet of a flexible film includes two layers of flexible film laminated together by an adhesive, and wherein said form is imprinted on a surface of one of the two layers confronting the other one of the two layers, so that the form is contained between the two layers.

20. The device of claim 17 wherein said fastening layer of an adhesive material includes an adhesive material of a first kind in a central area and an adhesive material of a second kind in a narrow peripheral border strip at least partially surrounding said central area, said adhesive material of said second kind being capable of limiting spread of said adhesive of said first kind when said release liner sheet is adhered to said layer of adhesive material of said second kind.

21. The device of claim 20 wherein said first kind of adhesive material is a hydrogel.

22. The device of claim 21 wherein said second kind of adhesive material is an acrylic-based adhesive material.

23. The device of claim 22 wherein said peripheral border strip has a width of at least about 0.25 inch.

24. The device of claim 20 wherein said first kind of adhesive material is a hydrocolloid.

25. The device of claim 24 wherein said second kind of adhesive material is an acrylic-based adhesive material.

26. The device of claim 25 wherein said border strip has a width of at least about 0.25 inch.

27. The device of claim 17 wherein said release liner sheet is stiffer than said sheet of a flexible film.

28. The device of claim 17 including a lanyard attachment.

29. The device of claim 17 wherein said adhesive material of said fastener layer is an acrylic-based adhesive material.

30. The device of claim 17 wherein said adhesive material of said fastener layer is a rubber-based adhesive material.

31. The device of claim 17 wherein said flexible film is of polyurethane.

32. The device of claim 17 wherein said flexible film is of polyethylene.

33. The device of claim 17 wherein said flexible film has a thickness in the range of 0.001 inch-0.005 inch.

* * * * *